US009635966B1

(12) United States Patent
Procaccini

(10) Patent No.: US 9,635,966 B1
(45) Date of Patent: May 2, 2017

(54) STACKABLE GEAR SUPPORT STAND

(71) Applicant: Gregory B. Procaccini, Alexandria, VA (US)

(72) Inventor: Gregory B. Procaccini, Alexandria, VA (US)

( * ) Notice: Subject to any disclaimer, the term of this patent is extended or adjusted under 35 U.S.C. 154(b) by 0 days.

(21) Appl. No.: 15/189,110

(22) Filed: Jun. 22, 2016

(51) Int. Cl.

| | |
|---|---|
| ***A47G 25/06*** | (2006.01) |
| ***A47B 43/00*** | (2006.01) |
| ***A47B 81/00*** | (2006.01) |
| ***A47F 8/00*** | (2006.01) |
| ***A47B 47/00*** | (2006.01) |
| ***A47F 7/24*** | (2006.01) |
| ***A47F 5/04*** | (2006.01) |

(52) U.S. Cl.
CPC ..... *A47G 25/0685* (2013.01); *A47B 43/00* (2013.01); *A47B 47/00* (2013.01); *A47B 81/00* (2013.01); *A47F 5/04* (2013.01); *A47F 7/24* (2013.01); *A47F 8/00* (2013.01); *A47G 25/0664* (2013.01)

(58) Field of Classification Search
CPC ..... A47G 25/0685; A47G 25/0671; A47G 25/0664; A47F 5/04; A47F 5/06; A47F 8/00; A47F 7/24; A47B 81/00; A47B 43/00; A47B 47/00
USPC ..... 211/85.3; 248/461
See application file for complete search history.

(56) References Cited

U.S. PATENT DOCUMENTS

| | | | | |
|---|---|---|---|---|
| 863,820 | A | 8/1907 | Wingert | |
| 1,748,597 | A * | 2/1930 | Collins | A47G 25/0664 211/172 |
| 2,430,840 | A * | 11/1947 | Westfall | A47G 33/12 248/529 |
| 4,407,182 | A * | 10/1983 | Biasini | F16M 11/22 248/170 |
| 4,662,132 | A | 5/1987 | Tennant | |
| RE34,376 | E * | 9/1993 | Branback | B65H 49/305 242/129 |
| 5,819,961 | A | 10/1998 | Harris | |
| 6,454,145 | B1 | 9/2002 | Russ | |
| 6,749,073 | B2 | 6/2004 | McNab | |
| 7,942,362 | B1 * | 5/2011 | Rothell | B65H 49/305 242/401 |
| 2009/0071922 | A1 | 3/2009 | Barra | |
| 2014/0158652 | A1 | 6/2014 | Dubose | |

OTHER PUBLICATIONS

"My personal wooden body armor stand", Feb. 4, 2016 Accessed, URL: www.pinterest.com/pin/447686019178904778/.
"How to Build a Tactical Gear Stand", Oct. 13, 2009 published, Jun. 20, 2016 Accessed, URL: http://www.itstactical.com/.

* cited by examiner

*Primary Examiner* — Korie H Chan
(74) *Attorney, Agent, or Firm* — Maier & Maier, PLLC

(57) ABSTRACT

A stackable gear support stand may be provided. The stackable gear support stand may have an elongated central member, a bottom leg member, a top leg member, and a cross member. The bottom leg member, top leg member, and cross member may be stacked horizontally on a vertically oriented central member to form a working support stand. The bottom leg member, top leg member, and cross member may alternatively be stacked coaxially on the central member to form a collapsed storage and transportation orientation.

11 Claims, 11 Drawing Sheets

STACKABLE GEAR SUPPORT STAND

BACKGROUND

Certain articles of clothing, apparel, and protective gear have unique aspects that make storage cumbersome. Additionally, some articles may be damaged unless stored in a particular orientation or environment. Therefore, specialized storage devices may be necessary to properly store and preserve such articles.

In many cases, the wearers of these articles may travel with the articles. Therefore, a transportable storage apparatus may be desired.

SUMMARY

According to an exemplary embodiment, a gear support stand may be provided. A gear support stand may have an elongated central member having a top and bottom with a base plate disposed on the bottom and a cross member lip disposed along the central member's length. The gear support stand may further have a hollow, elongated bottom leg member with open ends and a bottom leg member hole. The bottom leg member hole may be capable of passing over the central member in a working orientation. The open ends may pass over the top of the central member in a storage orientation, such that a portion of the central member and any intervening members is disposed inside the hollow bottom leg member. The stand may further have a hollow, elongated top leg member with open ends and a top leg member hole. The top leg member hole may be capable of passing over the central member in a working orientation. The open ends may pass over the top of the central member in a storage orientation, such that a portion of the central member and any intervening members is disposed inside the hollow top leg member. The stand may further have a hollow, elongated cross member with open ends and a cross member hole, wherein the cross member hole is capable of passing over a portion of the central member and rest on the cross member lip in a working orientation. The cross member open ends are capable of passing over the central member in a storage orientation, such that a portion of the central member and any intervening members is disposed inside the hollow cross member.

According to another exemplary embodiment, a gear support stand may be provided. The stand may include a central member, a bottom leg member, a top leg member, and a cross member. The bottom leg member, top leg member, and cross member may be capable of stacking over the central member coaxially. The bottom leg member may further have a bottom leg member hole, the top leg member may further have a top leg member hole, and the cross member may further have a cross member hole. The holes may be capable of passing over the central member, such that the bottom leg member, top leg member, and cross member are oriented perpendicularly to the central member.

According to yet another exemplary embodiment, a method of utilizing a gear support stand may be provided. The stand may be utilized by standing a central member in a vertical orientation. A bottom leg member hole of a bottom leg member may be passed over the central member, such that the bottom leg member rests in a horizontal orientation at a bottom of the central member. A top leg member hole of a top leg member may be passed over the central member, such that the top leg member rests in a horizontal orientation at the bottom of the central member, perpendicular to the bottom leg member. A cross member hole of a cross member may be passed over the central member, such that the cross member rests on a cross member support lip disposed on the central member.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
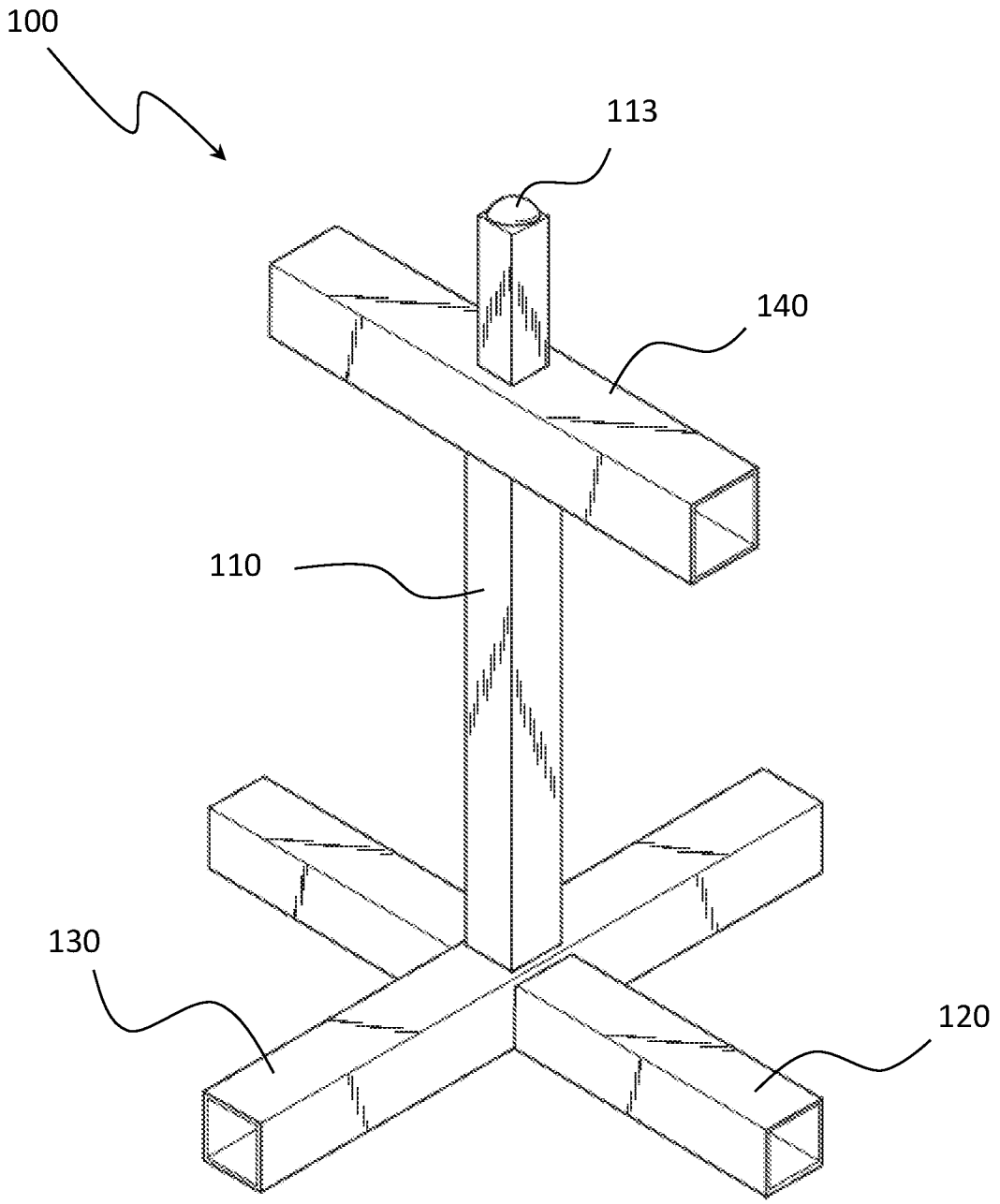
FIG. 1 is a perspective view of an exemplary embodiment of a gear support stand in a working orientation.
Figure 2:
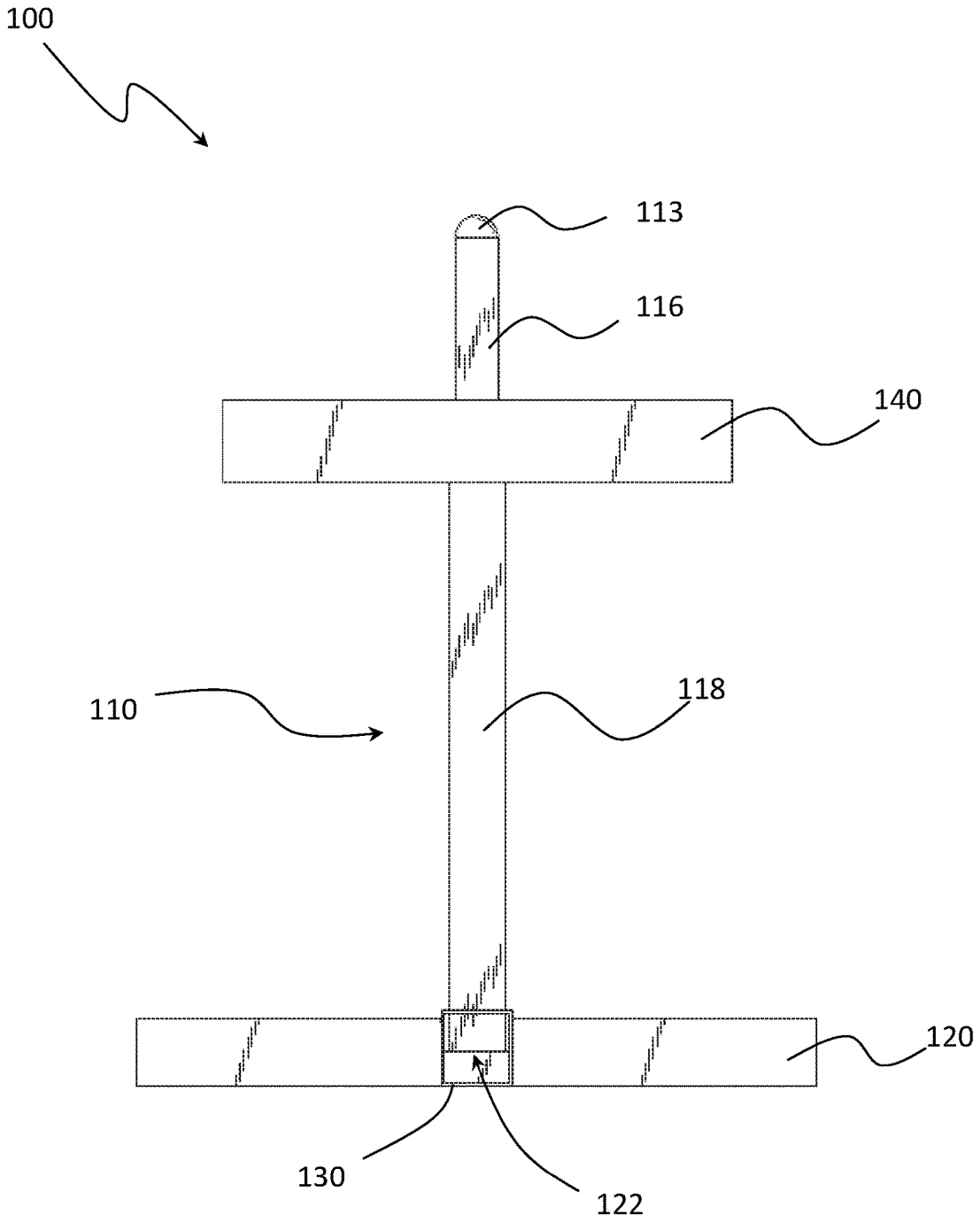
FIG. 2 is a front elevation view of an exemplary embodiment of a gear support stand in a working orientation.
Figure 3:
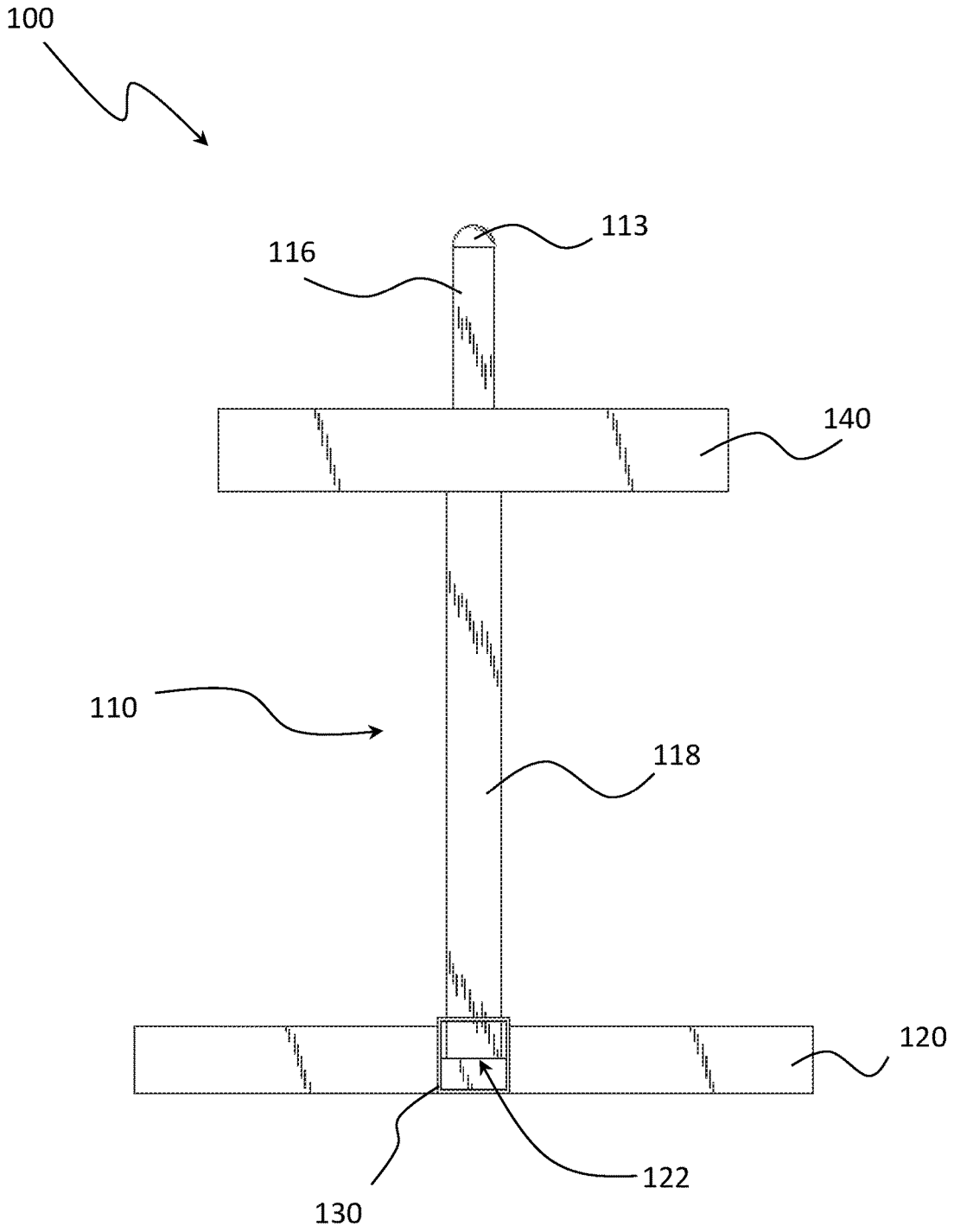
FIG. 3 is a rear elevation view of an exemplary embodiment of a gear support stand in a working orientation.
Figure 4:
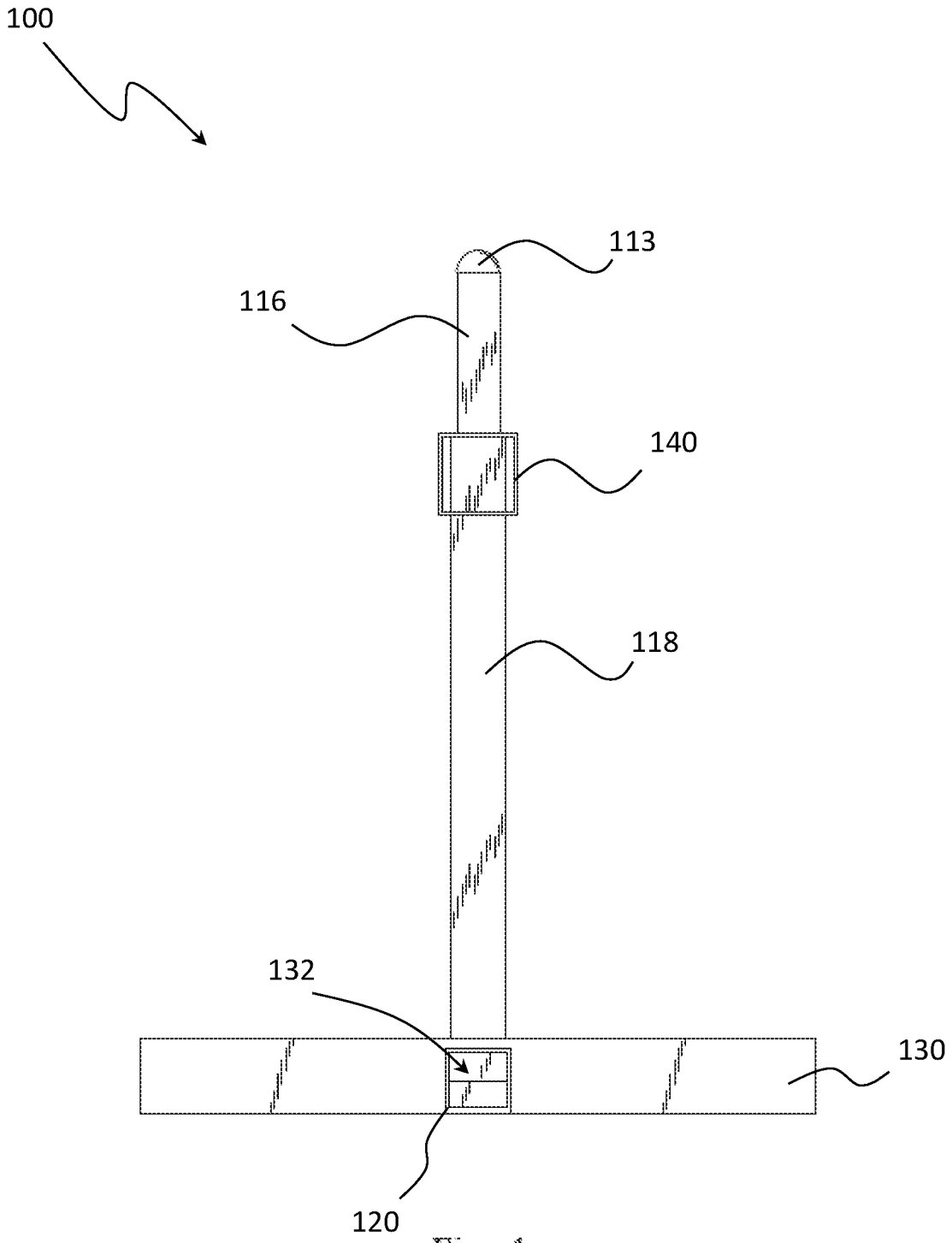
FIG. 4 is a right elevation view of an exemplary embodiment of a gear support stand in a working orientation.
Figure 5:
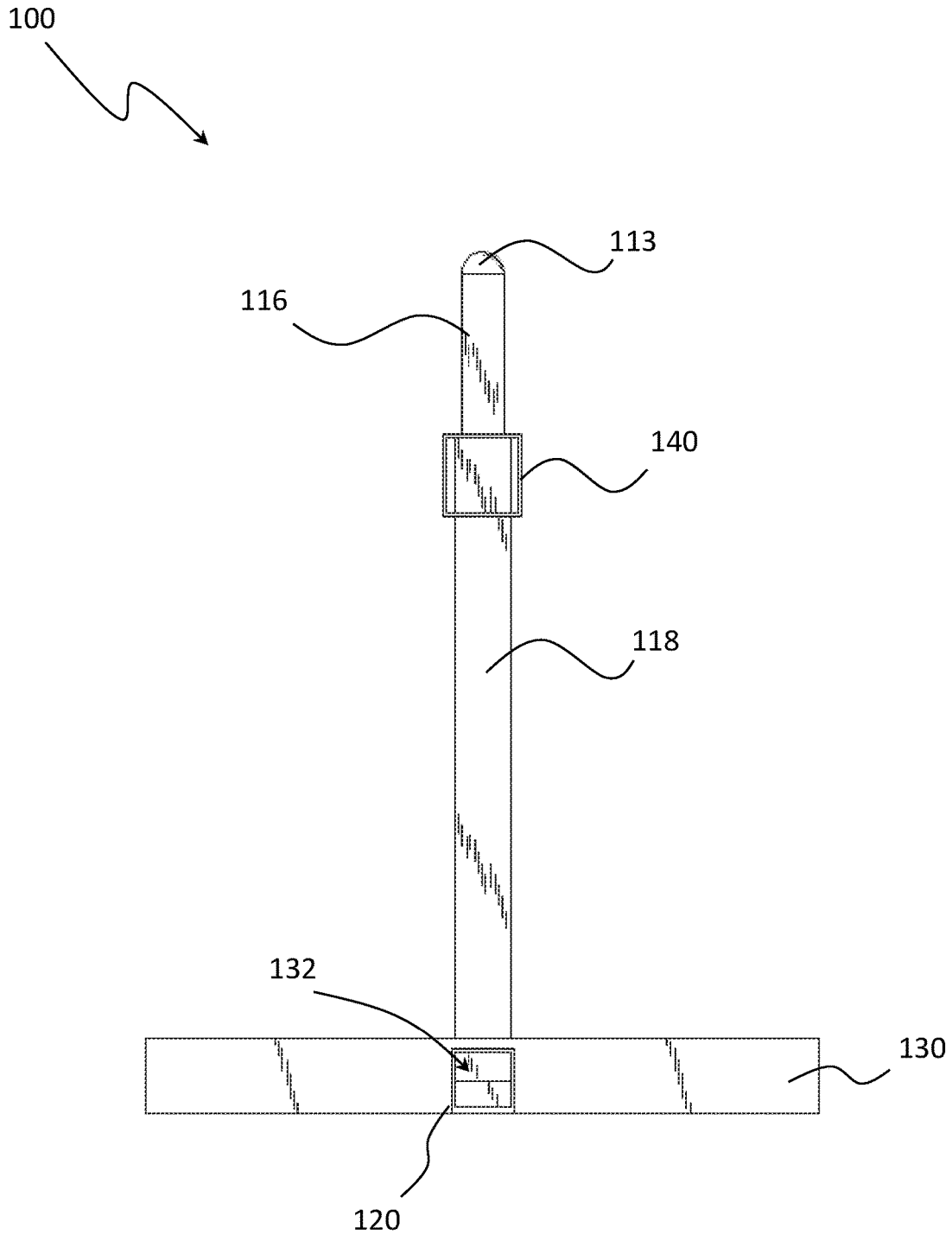
FIG. 5 is a left elevation view of an exemplary embodiment of a gear support stand in a working orientation.
Figure 6:
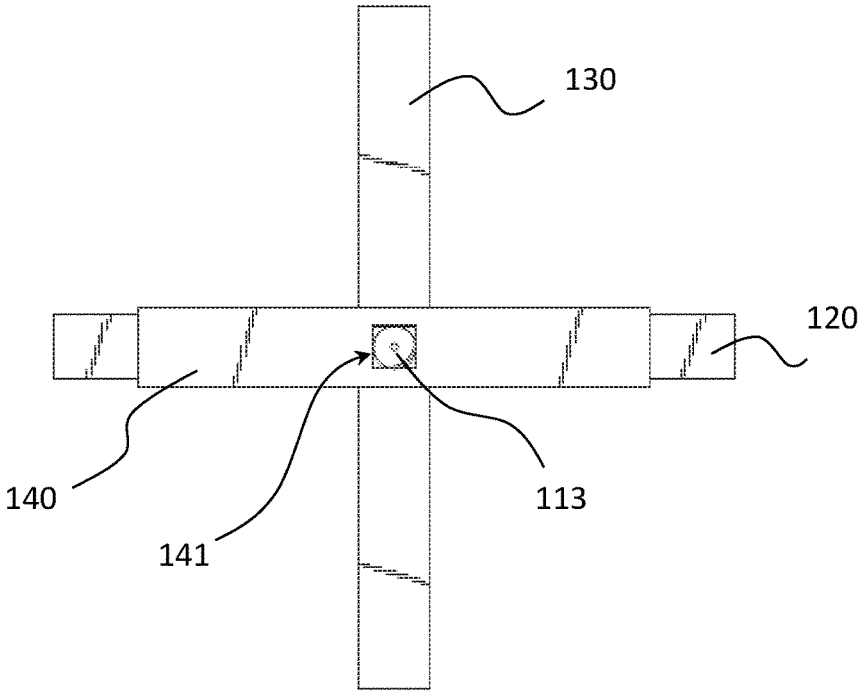
FIG. 6 is a top plan view of an exemplary embodiment of a gear support stand in a working orientation.
Figure 7:
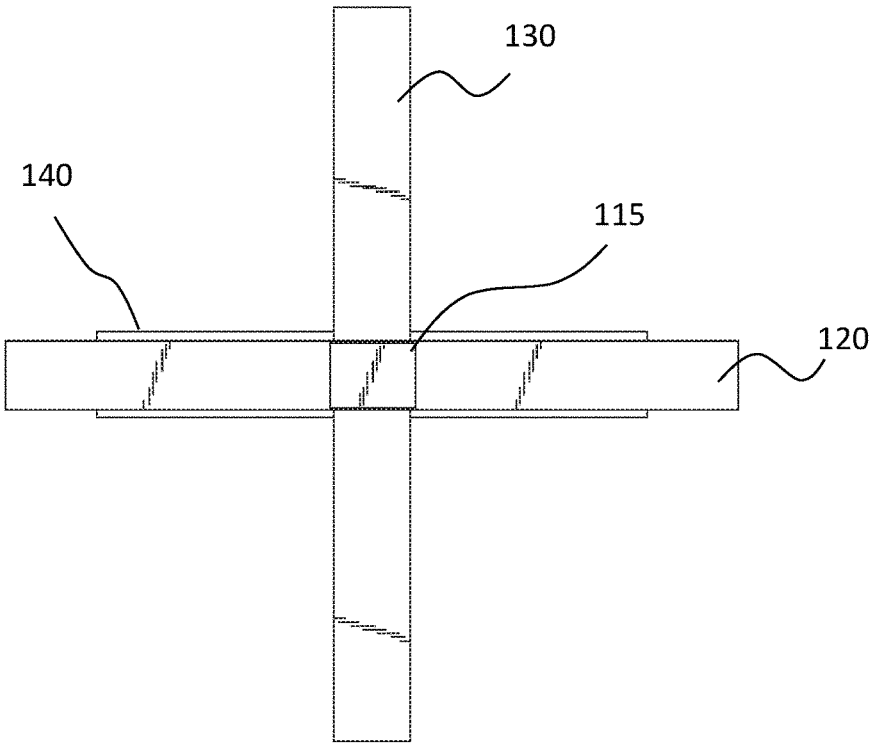
FIG. 7 is a bottom plan view of an exemplary embodiment of a gear support stand in a working orientation.
Figure 8:
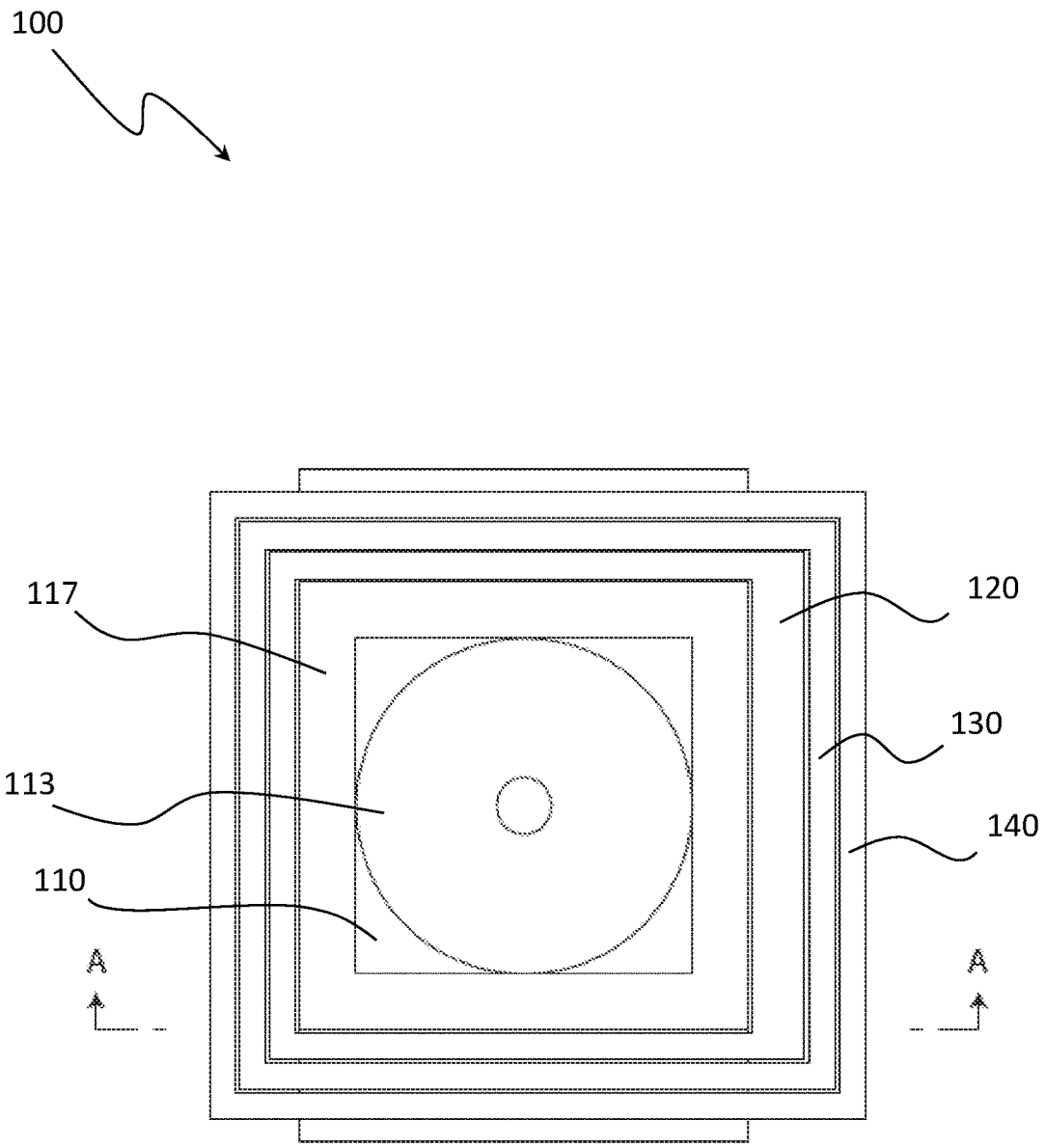
FIG. 8 is a top plan view of an exemplary embodiment of a gear support stand in a storage and transportation orientation.
Figure 9:
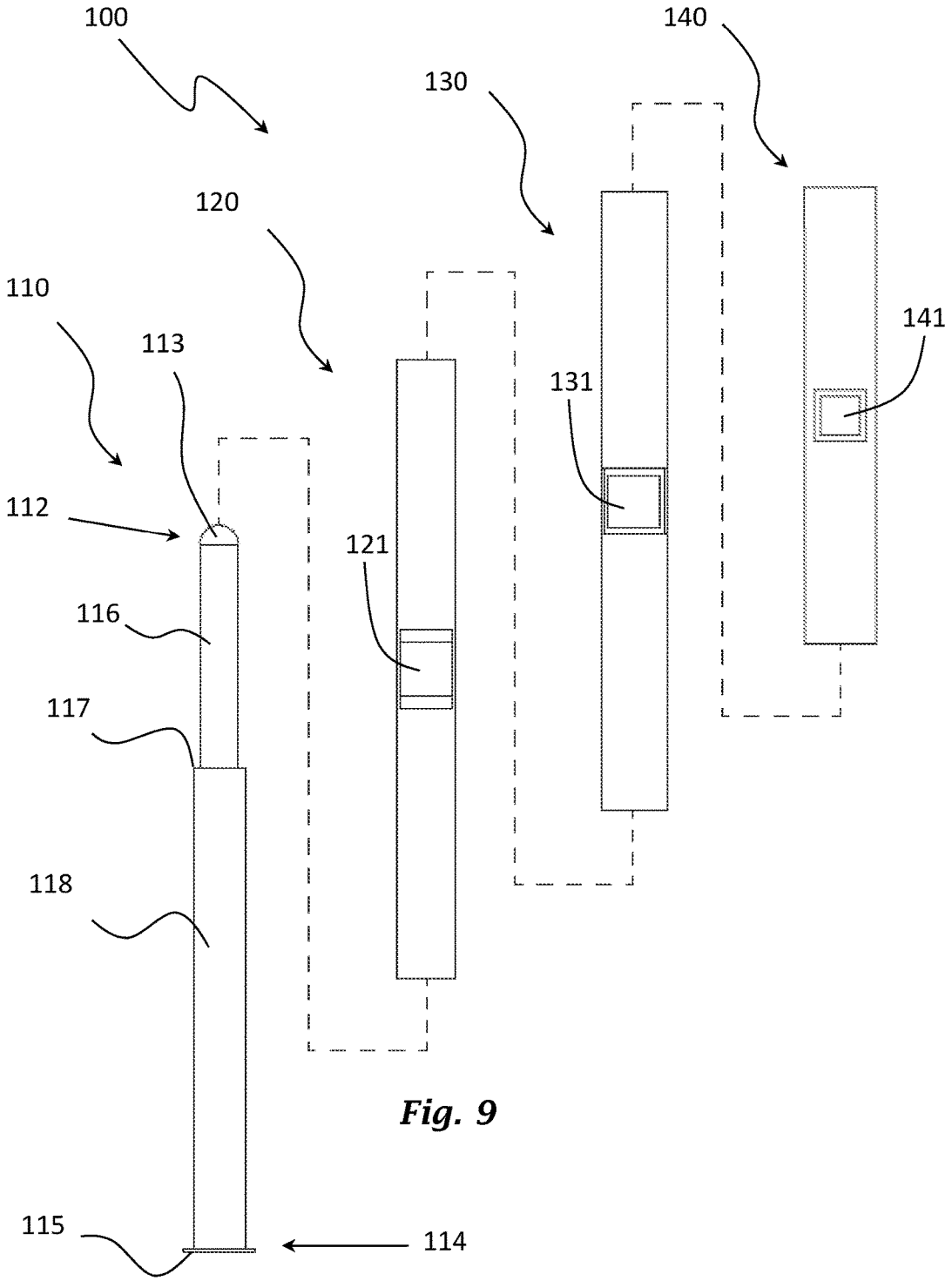
FIG. 9 is an exploded view of an exemplary embodiment of a gear support stand in a storage and transportation orientation.
Figure 10:
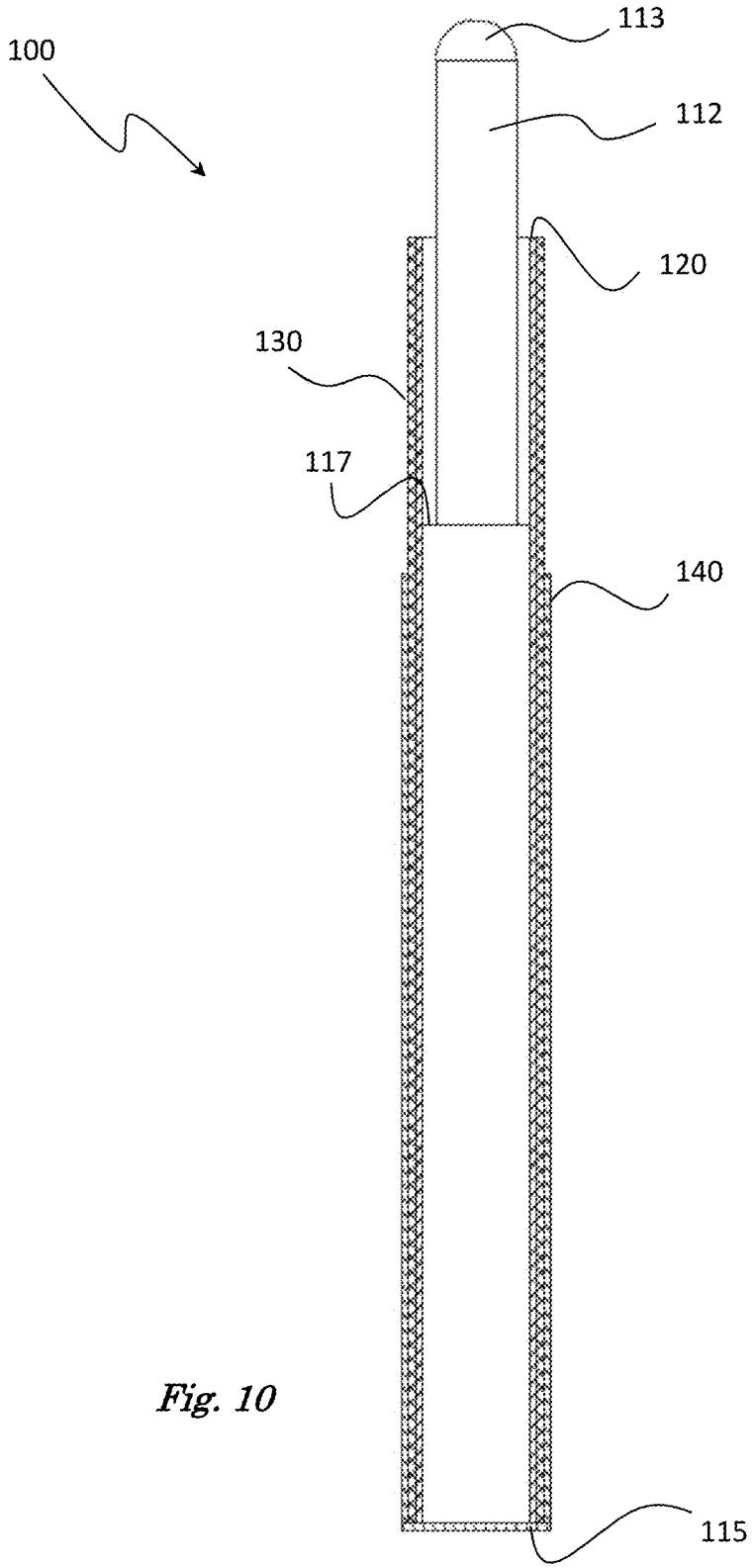
FIG. 10 is a cross-sectional view of an exemplary embodiment of a gear support stand in a storage and transportation orientation from perspective A in FIG. 8.
Figure 11:
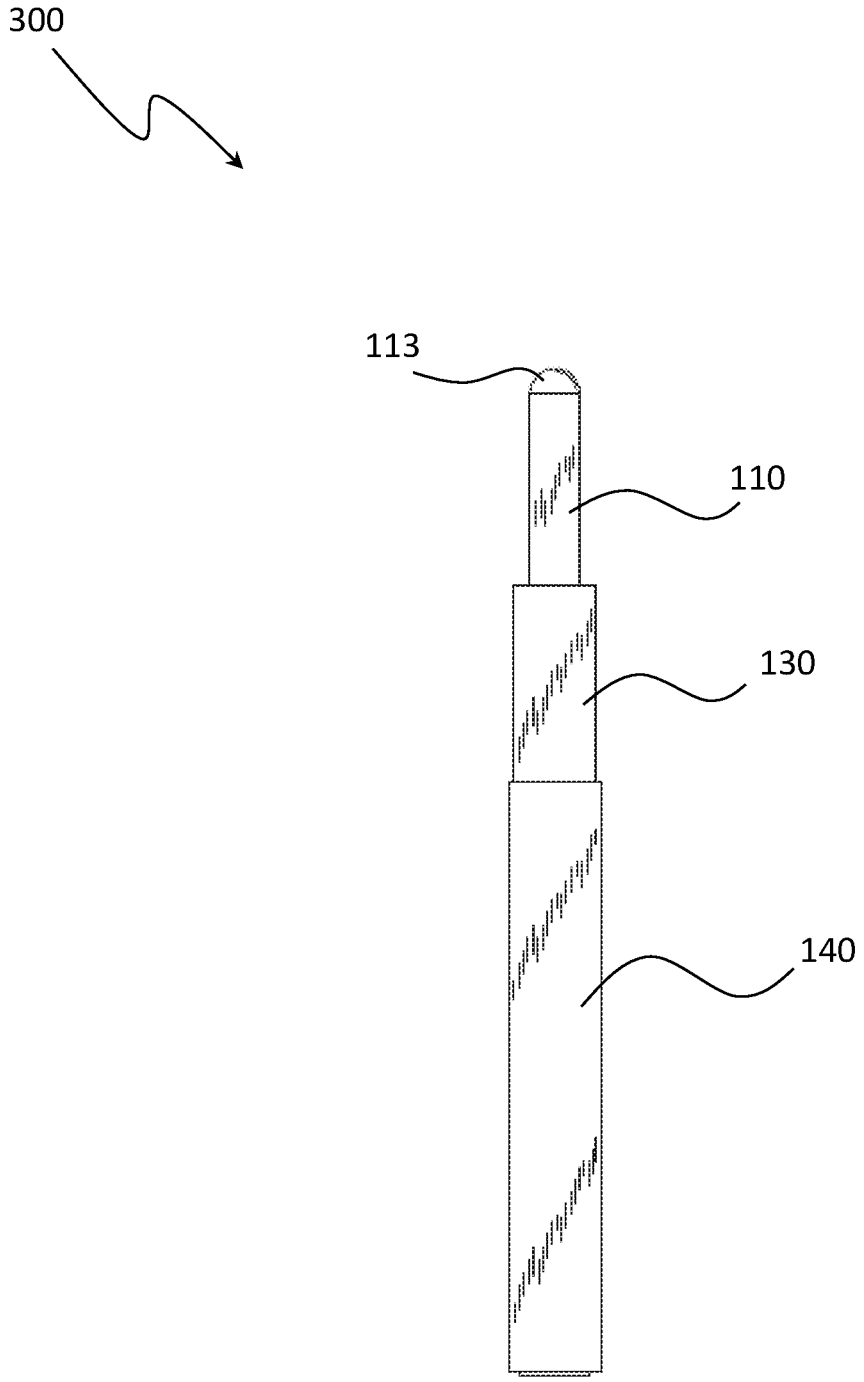
FIG. 11 is a side elevation view of an exemplary embodiment of a gear support stand in a storage and transportation orientation.
Figure 12:
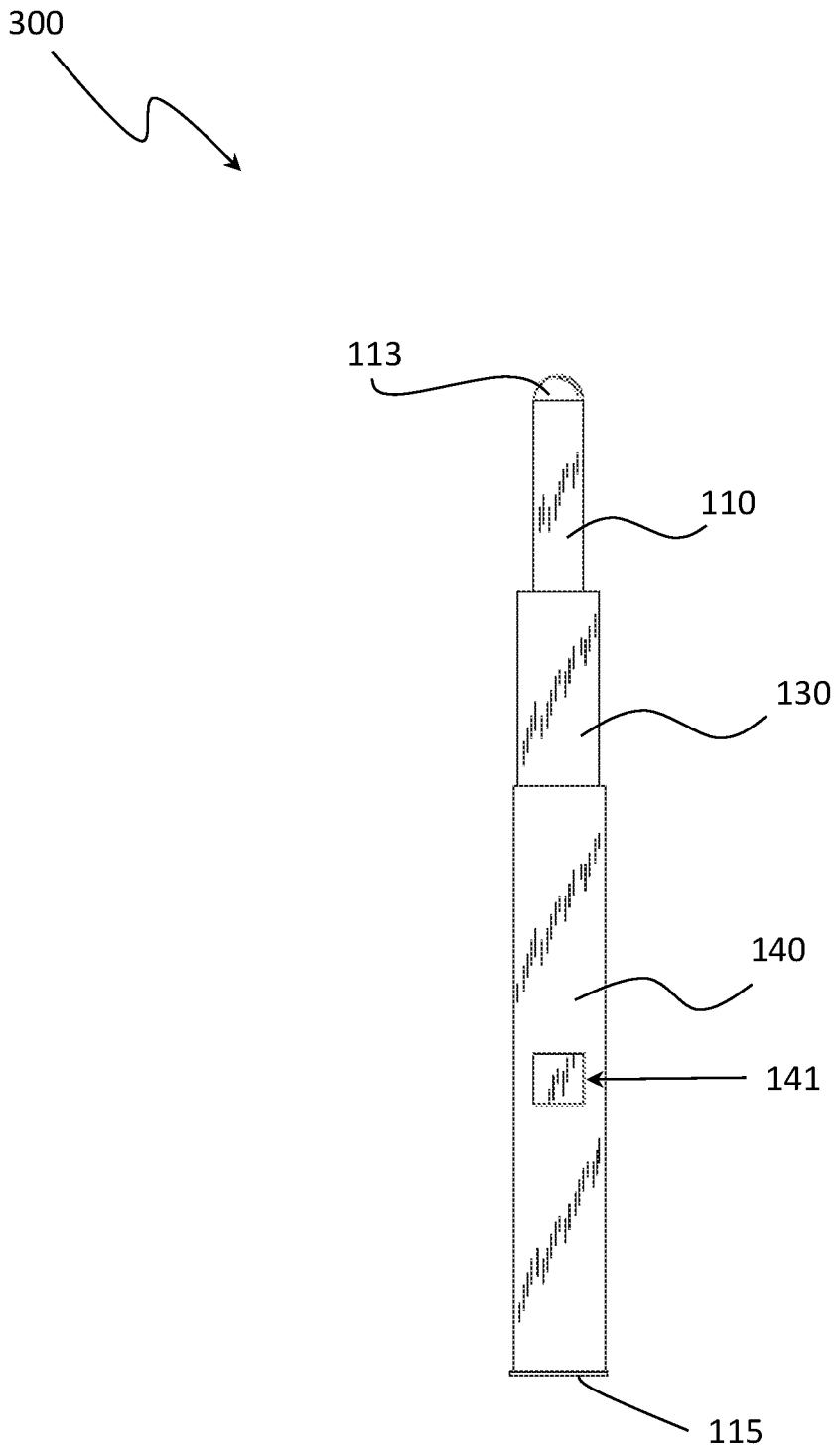
FIG. 12 is another side elevation view of an exemplary embodiment of a gear support stand in a storage and transportation orientation.

Referring to the Figures generally, a gear support stand 100 may be provided. Gear support stand 100 may have a number of substantially elongated members, including a central member 110, a bottom leg member 120, a top leg member 130, and a cross member 140. The members may be capable of deploying in a working orientation 200 or stacking in a storage and transport orientation 300. In a working orientation 200, the bottom leg member 120, top leg member 130, and cross member 140 may be capable of sliding over a vertically oriented central member 110 and resting in respective desired horizontal orientations to form support legs and a cross member for the gear support stand 100. In a storage orientation 300, as shown in FIGS. 8-12, the bottom leg member 120, top leg member 130, and cross member 140 may be capable of sliding over central member 110 such that they are coaxial with central member 110.

Central member 110 may be an elongated member having a top end 112 and a bottom end 114. Central member 110 may have a rectangular, circular, or other desired cross-sectional shape or combination thereof, as would be understood by a person having ordinary skill in the art. Central member 110 may optionally be hollow or may optionally be solid. A top portion 116 of central member 110 proximate top end 112 may have a smaller cross-section than a main portion 118 of central member 110. A cross member support lip 117 may be formed at the intersection of the main portion 118 and top portion 116. The top end 112 may further include a semi-spherical helmet cap 113. Bottom end 114 may optionally include a base plate 115. Base plate 115 may optionally extend beyond the cross-sectional perimeter of central member 110 in at least one direction. In at least one exemplary embodiment, base plate 115 may extend beyond the cross-sectional perimeter of central member 110 in two opposing directions. Base plate 115 may prevent leg members 120, 130 and cross member 140 from sliding past the bottom end 114 in a storage and transport orientation 300. Base plate may optionally prevent leg members 120, 130 from sliding past the bottom end 114 in a working orientation 200. According to some exemplary embodiments where central member is hollow, there may be at least one hole in central member to allow communication between the interior and exterior. In some embodiments, there may be a hole in helmet cap 113. There may optionally also be a hole in base plate 115.

Still referring to the Figures generally, bottom leg member 120 may be a substantially hollow elongated member with open ends. Bottom leg member 120 may optionally have an interior cross-section similarly shaped to the cross-section of central member 110. The interior cross-section of bottom leg member 120 may fit around the cross-section of central member 110, such that bottom leg member 120 can slide over central member 110 in a coaxial manner. Bottom leg member 120 may slide over central member 110 from the top end 112 and base plate 115 may prevent bottom leg member 120 from sliding beyond the bottom end 114. Bottom leg member 120 may also have a hole 121 disposed through it, perpendicular to its elongated axis. Hole 121 may have a cross section capable of passing over central member 110, more particularly the main portion 118. When hole 121 is passed over central member 110, bottom leg member 120 may rest perpendicularly to central member 110. Bottom leg member 120 may be notched at hole 121, forming notch 122. Notch 122 may be capable of engaging a corresponding notch on top leg member 130. Bottom leg member 120 may be stacked coaxially on central member 110 or any desired intervening members for storage and transportation purposes and may be stacked perpendicularly for working purposes. Bottom leg member 120 and hole 121 may further be shaped and sized to accommodate base plate 115, such that when bottom leg member 120 is in a working orientation, the bottom surface of bottom leg member 120 is level with the bottom surface of base plate 115. In some exemplary embodiments, hole 121 may have a larger area on a bottom surface of bottom leg member 120 than on a top surface of leg member 120 to accommodate base plate 115, as would be understood by a person having ordinary skill in the art.

Gear support stand 100 may further have a top leg member 130, which may be a substantially hollow elongated member with open ends. Top leg member 130 may optionally have an interior cross-section similarly shaped to the cross-section of bottom leg member 120. The interior cross-section of top leg member 130 may be capable of sliding over bottom leg member 120 in a coaxial manner. Top leg member 130 may slide over bottom leg member 120 when bottom leg member 120 is slid over central member 110. Similarly, base plate 115 may prevent top leg member 130 from sliding beyond the bottom end 114 of the central member 110. Top leg member 130 may also have a hole 131 disposed through it, perpendicular to its elongated axis. Hole 131 may have a cross section capable of passing over central member 110, more particularly the main portion 118. When hole 131 is passed over central member 110, top leg member 120 may rest perpendicularly to central member 110. Top leg member 130 may further be notched at hole 131, forming notch 132. In some exemplary embodiments, top leg member 130 may be perpendicular to bottom leg member 120, when gear support stand 100 is in a working orientation. Notches 122 and 132 may engage each other such that top leg member 130 and bottom leg member 120 form a level support. In other exemplary embodiments, top leg member 130 may be oblique to bottom leg member 120. Top leg member 130 may be stacked coaxially on central member 110 or any desired intervening members for storage and transportation purposes and may be stacked perpendicularly for working purposes.

Gear support stand 100 may also include a cross member 140, which may be a substantially hollow elongated member with open ends. Cross member 140 may optionally have an interior cross-section similarly shaped to the cross-section of top leg member 130. The interior cross-section of cross member 140 may be capable of sliding over top leg member 130 in a coaxial manner. Cross member 140 may slide over top leg member 130 when top leg member 130 is slid over bottom leg member 120 and bottom leg member 120 is slid over central member 110. Similarly, base plate 115 may prevent cross member 140 from sliding beyond the bottom end 114 of the central member 110. Cross member 140 may also have a hole 141 disposed through it, perpendicular to its elongated axis. Hole 141 may have a cross section capable of passing over central member 110. Hole 141 may have equal or varied size openings on opposing sides of cross member 140. At least one of the openings of hole 141 may be sized such that it cannot pass over main portion 118, but instead passes over top portion 116 and rests against lip 117. This may cause cross member 140 to be suspended perpendicularly to central member 110. Cross member 140 may be stacked coaxially on central member 110 and any desired intervening members for storage and transportation purposes and may be stacked perpendicularly for working purposes.

Gear support stand 100 may further include fasteners to secure a desired orientation. For example, gear support stand 100 may include pins, straps, clips, or other fasteners as would be understood by a person having ordinary skill in the art. Additionally, the increasing cross-sectional area and order of stacking of the legs and cross member may be any desired order, as would be understood by a person having ordinary skill in the art. Gear support stand may be made of any desired combination of materials such as plastics, rubber, ceramics, metal, wood, polymers, composites, or other materials as would be understood by a person having ordinary skill in the art.

The gear support stand may be set up in a working orientation forming a support structure mimicking the features of a person. The cross member may form arm-like supports and the helmet cap may form a head-like support. Equipment, such as armor, ballistic vests, helmets, or other protective gear as would be understood by a person having ordinary skill in the art, may be stored on the stand in a working orientation. The gear may be stored such that it is in an orientation similar to when it is in use. This orientation may allow the gear to maintain a desired form and may expose its surface to ambient air for drying purposes. The gear support stand may also be placed in a collapsed orientation for easy storage and transportation. The cross member and leg members may all be stacked on the central member, resulting in a smaller, more manageable structure for storing and transporting.

The foregoing description and accompanying figures illustrate the principles, preferred embodiments, and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A gear support stand comprising:

an elongated central member having a top and bottom with a base plate disposed on the bottom and a cross member lip disposed along a length of the central member;

a hollow, elongated bottom leg member with open ends and a bottom leg member hole, wherein the bottom leg member hole is configured to pass over central member in a working orientation, and wherein the bottom leg member open ends are configured to pass over the top of the central member in a storage orientation, such that a portion of the central member is disposed inside the hollow bottom leg member;

a hollow, elongated top leg member with open ends and a top leg member hole, wherein the top leg member hole is configured to pass over the central member in a working orientation, and wherein the top leg member open ends are configured to pass over the top the central member in a storage orientation, such that a portion of the central member is disposed inside the hollow top leg member; and a hollow, elongated cross member with open ends and a cross member hole, wherein the cross member hole is configured to pass over a portion of the central member and rest on the cross member lip in a working orientation, and wherein the cross member open ends are configured to pass over the central member in a storage orientation, such that a portion of the central member is disposed inside the hollow cross member, wherein the central member, bottom leg member, top leg member, and cross member have the same cross-sectional shape.

2. The stand of claim 1, further comprising a helmet cap disposed on a top end of the central member.

3. The stand of claim 1, wherein the open ends of the bottom leg member, top leg member, and cross member are not able to pass over the base plate.

4. The stand of claim 1, wherein the bottom leg member further comprises a bottom leg member notch at bottom leg member hole and the top leg member further comprises a top leg member notch at top leg member hole, such that the notches of the top and bottom leg members form a notched fit to secure the orientations of the bottom leg member and top leg member.

5. The stand of claim 1, wherein the cross member lip is formed by a change in at least one of cross-sectional shape and area of the central member.

6. The stand of claim 1, wherein the bottom leg member hole is configured to pass over the base plate when in a working orientation, such that a bottom surface of the bottom leg member is coplanar with a bottom surface of the base plate.

7. The stand of claim 1, wherein the hollow cross-sectional area of the cross member is sized to accommodate the cross-sectional area of the top leg member, the hollow cross-sectional area of the top leg member is sized to accommodate the cross-sectional area of the bottom leg member, and the hollow cross-sectional area of the bottom leg member is sized to accommodate the cross-sectional area of the central member.

8. The stand of claim 1, wherein the central member is oriented vertically in a working orientation and the bottom leg member, top leg member, and cross member are oriented horizontally in a working orientation.

9. A gear support stand comprising:

a central member, a bottom leg member, a top leg member, and a cross member, wherein the bottom leg member, top leg member, and cross member are configured to stack over the central member coaxially, wherein the bottom leg member comprises a bottom leg member hole, the top leg member comprises a top leg member hole, and the cross member comprises a cross member hole, the holes being configured to pass over the central member, such that the bottom leg member, top leg member, and cross member are oriented perpendicularly to the central member, and wherein the central member further comprises a base plate on a bottom end for stopping the bottom leg member, top leg member, and cross member from passing beyond the bottom end when stacked coaxially from a top end.

10. The gear support stand of claim 9, wherein a cross member lip is disposed on the central member, and wherein the cross member hole is configured not to pass over the cross member lip, such that the cross member is supported in a horizontal orientation at the cross member lip.

11. A method of utilizing a gear support stand comprising:

standing a central member in a vertical orientation;

passing a bottom leg member hole of a bottom leg member over the central member, such that the bottom leg member rests in a horizontal orientation at a bottom of the central member;

passing a top leg member hole of a top leg member over the central member, such that the top leg member rests in a horizontal orientation at the bottom of the central member, perpendicular to the bottom leg member;

passing a cross member hole of a cross member over the central member, such that the cross member rests on a cross member support lip disposed on the central member; and collapsing the stand by removing the bottom leg member, top leg member, and cross member from the central member; sliding an open end of the bottom leg member over a top end of the central member, such that the central member is disposed within a hollow interior of the bottom leg member; sliding an open end of the top leg member over a top end of the central member and the bottom leg member, such that the central member and bottom leg member are disposed within a hollow interior of the bottom leg member; and sliding an open end of the cross member over a top end of the central member, bottom leg member, and top leg member, such that the central member, bottom leg member, and top leg member are disposed within a hollow interior of the bottom leg member.

* * * * *